United States Patent [19]

Kohl et al.

[11] Patent Number: 4,919,728

[45] Date of Patent: Apr. 24, 1990

[54] METHOD OF MANUFACTURING NONMAGNETIC DRILLING STRING COMPONENTS

[75] Inventors: Heinz Kohl, Ternitz; Helmut Pohl, Neunkirchen; Alois Püchl, Grimmenstein, all of Austria

[73] Assignee: Vereinigte Edelstahlwerke AG (VEW), Vienna, Austria

[21] Appl. No.: 219,216

[22] Filed: Jul. 15, 1988

Related U.S. Application Data

[63] Continuation-in-part of Ser. No. 866,940, May 27, 1986, abandoned.

[30] Foreign Application Priority Data

Jun. 25, 1985 [AT] Austria ..... 1879/85

[51] Int. Cl.[5] ..... C21D 8/00

[52] U.S. Cl. ..... 148/12 B; 148/12.4; 148/12 R

[58] Field of Search ..... 148/12 B, 12 E, 12.4, 148/327, 2, 12 R

[56] References Cited

U.S. PATENT DOCUMENTS 4,472,207 9/1984 Kinoshita et al. ..... 148/12 B

*Primary Examiner*—Deborah Yee

*Attorney, Agent, or Firm*—Werner W. Kleeman

[57] ABSTRACT

The method of manufacturing nonmagnetic drilling string components, especially heavy duty drill-stems for exploratory bores, e.g. for deposits of crude oil and/or natural gas deposits, such as directional bores or the like, includes the step of melting and allowing to solidify an alloy consisting essentially of, each in percent by weight:

carbon in a maximum of 0.15, preferably 0.08;
silicon in a maximum of 1.0;
manganese 11.0 to 25.0, preferably 12.0 to 20.0;
chromium 10.0 to 20.0, preferably 11.0 to 16.0;
molybdenum 0.1 to 1.0, preferably 0.2 to 0.8;
nickel 0.1 to 6.0, preferably 1.0 to 3.0;
nitrogen 0.05 to 0.5, preferably 0.1 to 0.35; and the remainder being iron and impurities resulting from manufacturing conditions. The alloy is subjected to an at least two-stage, especially a four- to six-stage hot-working process and, if desired, cooled down and then solution heat-treated at about 1,020° C. to about 1,070° C. Subsequently, the alloy is quenched, for example, in water and subjected to a cold-working operation. The cold-working operation is carried out at a temperature above the martensite formation temperature, i.e. above the temperature range of 300° C. to 350° C. and below approximately 700° C., in particular below the Curie point of iron, and with at least 5%, preferably at least 12% deformation.

38 Claims, No Drawings

METHOD OF MANUFACTURING NONMAGNETIC DRILLING STRING COMPONENTS

CROSS-REFERENCE TO RELATED APPLICATION

The present application is a continuation-in-part application of our U.S. patent application Ser. No. 06/866,940, filed on May 27, 1986 and entitled: "METHOD OF MANUFACTURING NON-MAGNETIC DRILLING STRING COMPONENTS" now abandoned.

BACKGROUND OF THE INVENTION

The present invnetion broadly relates to a new and improved method of manufacturing nonmagnetic drilling string components.

In its more particular aspects, the present invention relates to a method of manufacturing nonmagnetic drilling string components, in particular heavy-duty drill-stems for exploratory bores, e.g. for crude oil and/or natural gas deposits, such as directional bores or the like.

During the implementation of exploratory or prospecting bores, especially directional bores, the position and direction of the bores are established by magnetic measurement. Although measurements employing gyroscopic compasses have become known, preference is still accorded to the inherently very accurate and, when working with suitable materials, interference-free magnetic field measurements. Since bores of this type extend to increasingly greater depths, an especially exact position determination is required. This means that the drilling string components, in particular heavy-duty drill-stems which are located in the immediate proximity of the measuring instrument, for example, a so-called Förster probe, may only exhibit the most minute degree of magnetic anomalies. Thus it is known, for example, that heavy-duty drill-stems which produce a maxium compass deviation greater than $\pm 0.25°$, do not satisfy the requirements, or do so only in rare cases.

In addition to the nonmagnetic characteristics, as already explicity explained hereinbefore, these drilling string components, particularly heavy-duty drill-stems must possess high mechanical strength for withstanding tensile as well as compressive stress depending upon whether the drill head is subjected ot corresponding pressure or is withdrawn from the bore hole. Furthermore, these drilling string components, particularly heavy-duty drill-stems are subject to high torsional stress because the rotary motion of the drill head is at least partially carried out via such drilling string components. Furthermore, the alloys for such drilling string components, particularly heavy-duty drill-stems, must be suitable for providing thread connections which must be releasable without "jamming" or "seizing" even after long.periods of exposure to mechanical loads.

A further, very relevant criterion is the resistance to corrosion, especially stress corrosion cracking, since such drilling string components are often exposed to highly corrosive media such as, for example, multipercent sodium chloride solutions and/or magnesium chloride solutions as well as hydrogen sulphide and the like.

In addition to the criteria set forth above, it is a further substantial prerequisite for the economical deployment of such drilling string components that alloys are employed which can be used over a long period of time and which therefore are not subject to the criterion of composition changes due to raw material shortages or the like.

From, for example, Austrian Pat. No. 214,466, there is known the use of a nonmagnetic austenitic chromium manganese steel alloy for manufacturing nonmagnetic drilling string components containing, each in percent by weight:

up to 0.25 carbon;
up to 1.0 silicon;
12 to 25 manganese;
10 to 20 chromium;
up to 5 nickel;
up to 1 molybdenum;
0.05 to 0.5 nitrogen;

and the remainder being iron and the usual accompanying elements. Boron, niobium, tantalum and vanadium, among others, are listed as further optional or nonessential alloying elements. A particularly suitable nonmagnetic steel of this type contains, each in percent by weight, carbon up to a maximum of 0.12, silicon up to a maximum of 0.60, manganese 17.00 to 19.00, chromium 11.50 to 13.00, nickel 1.50 to 2.00, molybdenum 0.40 to 0.60, nitrogen 0.10 to 0.15, the remainder being iron and the usual accompanying elements.

The non-magnetic drilling strings are manufactured from such alloy by subjecting blanks to a number of processing steps including, among others, cold-working at room temperature in order to improve upon the mechanical properties of such austenitic steel, particularly increase the yield strength to the desired level. The thus-obtained drilling string components are not magnetizable by the strength of the terrestrial magnetic field. However, in stronger magnetic fields which can exist, for example, in the manufacturing environment, a permanent remanence can appear. When subjecting the thus manufactured drilling string components to an especially accurate final manufacturing control such as the method described in European Pat. No. 0,014,195, granted Sept. 16, 1981, ferromagnetic inclusions, pockets or islands were detected in the drilling strings which, therefore, had to be rejected because they are unsuited for carrying out the initially mentioned drilling operations because the ferromagnetic inclusions, pockets or islands cause unacceptable interferences with the initially mentioned magnetic measurements.

In a method of manufacturing blank material suitable for oil drilling nonmagnetic stabilizers such as known, for example, from U.S. Pat. No. 4,472,207, an ingot is produced from an austenitic nonmagnetic steel having the basic composition of, each in percent, carbon 0.05 to 3.0, manganese 16 to 25, and chromium 13 to 18. The ingot is subjected to a number of processing steps, such as hot-working in the temperature range of 800° C. to 1200° C., solution heat treatment in the temperature range of 1000° C. to 1150° C., water cooling, machining, cold compressive working in a specifically structured die in the temperature range of room temperature to 350° C., stress relief annealing in the temperature range of 200° C. to 350° C. and finish machining. The thus obtained stabilizer had a specific magnetic permeability in the range of 1.002 to below 1.01 which was considered as satisfying the nonmagnetic conditions requirements.

SUMMARY OF THE INVENTION

Therefore, with the foregoing in mind, it is a primary object of the present invention to provide a new and improved method of manufacturing nonmagnetic drilling string components, particularly heavy-duty drill-stems and which method does not exhibit the drawbacks and shortcomings of the prior art processes heretofore discussed.

Another and more specific object of the present invention aims at providing a new and improved method of manufacturing nomagnetic drilling string components, particularly heavy-duty drill-stems, which have a sufficiently high mechanical strength with only slight variation thereof, and which method includes a cold-working step.

Yet a further significant object of the present invention aims at providing a new and improved method of manufacturing nonmagnetic drilling string components, particularly heavy-duty drill-stems, and which method ensures that no or only insignificant islands or regions of magnetizable material remain in the thus produced drilling string components, particularly heavy-duty drill-stems, which thus are not subject to permanent magnetization even in the presence of strong magnetic fields.

Now in order to implement these and still further objects of the invention, which will become more readily apparent as the description proceeds, the method of the present development is manifested, among other things, by the features that, the alloy consists essentially of, each in percent by weight:

carbon in a maximum of 0.15, preferably 0.08;
silicon in a maximum of 1.0;
manganese 11.0 to 25.0, preferably 12.0 to 20.0;
chromium 10.0 to 20.0, preferably 11.0 to 16.0;
molybdenum 0.1 to 1.0; preferably 0.2 to 0.8;
nickel 0.1 to 6.0, preferably 1.0 to 3.0;
nitrogen 0.05 to 0.5, preferably 0.1 to 0.35;

and the remainder being iron and impurities resulting from the manufacturing conditions. The alloy is melted and allowed to solidify and thereafter subjected to an at least two-stage, especially a four- to six-stage hot-working operation, i.e. an at least 2:1, especially 4–6:1 area reduction if desired, cooled down and then solution heat-treated at temperature of about 1,020° C. to about 1,070° C. The alloy is subsequently quenched e.g. in water and subjected to a cold-working operation which substantially constitutes cold-working at a temperature above about 300° C. and below about 750° C., in particular below the Curie point of iron, and further includes at least a 5%, preferably at least a 12% deformation.

It has been found that in austenitic nonmagnetic low-carbon manganese-chromium steels of the type in question, magnetizable martensite can be formed by mechanical deformation at temperatures up to the range of 300° C. to 350° C. The conditions for martensite formation, therefore, are particularly favorable in those regions of the drilling string components, particularly heavy-duty drill-stems, which are subject to localized peak deformation stresses, especially peak shear stresses during the cold-working operation. During further processing, the drilling string components, particularly heavy-duty drill-stems, invariably become exposed to environmental magnetic fields which are sufficient to magnetize the locally formed martensite. Thus there are formed highly localized ferromagnetic inclusions, pockets or islands which render the drilling string component, particularly heavy-duty drill-stem useless for the intended purpose due to the initially mentioned interferences with the measurements of the terrestrial magnetic field during a drilling operation. Such ferromagnetic inclusions, pockets or islands are highly localized to such extent that they may escape notice when measuring bulk magnetic properties like, for example, magnetic permeability. However, they are detected when scanning the drilling string component, particularly the heavy-duty drill-stem for its effect on the measurement of the terrestrial magnetic field using, for example, the method as described in the aforementioned European Pat. No. 0,014,195.

However, when subjecting the austenitic low-carbon manganese-chromium steels to cold-working at temperature at the upper limit of the martensite formation temperature, i.e. in the temperature range of 300°C. to 350° C. or thereabove, it has also been found that the initially mentioned desired mechanical properties, especially the desired increase in yield strength could not be obtained to the desired extent so that the thus manufactured drilling string components, particularly heavy-duty drill-stems, although being free of undesired ferromagnetic inclusions, pockets or islands, proved wanting in respect of their mechanical strength. The inventive method mitigates this predicament by providing an alloy composition which can be cold-worked in a temperature range safely above the martensite formation temperature range and yet permits obtaining the aforementioned desired mechanical properties.

It has been found that, for achieving the desired mechanical strength, a deforamtion of at least 5%, preferably of at least 8%, is required. Higher deformations can also be quite possibly carried out, however, require longer deformation times.

With respect to cold-working, cold forging, especially stretch forging, has proved to be successful although different degrees of deformation may be present between the central and the marginal regions. According to a further feature of the present invention, a mechanical, in particular a machining operation, is carried out after the cold-working without any substantial processing impairments caused thereby.

In order to increase stress corrosion cracking resistance, inherent compressive stresses can be produced at the surface, e.g. by ball blasting at temperatures at or above the range of 300° C. to 350° C. and below approximately 550° C., in particular below the Curie point of iron, and thereby permanent magnetizability is prevented even under unfavorable conditions. The thus produced compressive stresses very effectively increase the resistance against intracrystalline and intercrystalline stress corrosion cracking.

According to an advantageous further development, the upper temperature limit for the cold-working operation can be held in the range of about 300° C. to about 400° C. when niobium or tantalum or a commercially available niobium/tantalum alloy is added in 0.1 to 2.0, preferably 0.4 to 0.8% by weight to the steel composition.

Furthermore, it has been found that the presence of relatively low concentrations of aluminum, boron and vanadium favorably affect the properites of the steel alloy when carrying out the invention method. Frequently these elements are already present in sufficient amounts, namely up to 0.5 aluminum, up to 0.005 boron and up to 0.3 vanadium, each in percent by weight. If not, these elements can be added and their preferred concentrations, each in percent by weight, are aluminum 0.5 to 0.5, boron 0.0005 to 0.005 (5 ppm to 50 ppm, i.e. parts per million), and vanadium 0.03 to 0.03.

DETAILED DESCRIPTION OF THE PREFERRED EMBODIMENTS

The invention will be better understood and objects other than those set forth above will become apparent when consideration is given to the following detailed description with reference to the Example and the annexed Tables I to III.

EXAMPLE

An alloy having the composition 010986 as given in Table 1 was melted and, in a known manner, cast into a block. This block was deformed using a stretch forging operation at temperatures between 900° C. and 1150° C. to a length of 9 meters which corresponds to a six-fold hot-working deformations, i.e. a 6:1 area reduction. The round rods or bars thus obtained were solution heat-treated for two hours at about 1,050° C. and subsequently quenched in water. The 0.2 elastic limit amounted to 400±50N/mm$^2$. The thus pretreated rods were then heated to about 400° C. and cold-worked by subjecting to a 12 percent deformation by forging on a stretch forging machine. The 0.2 elastic limit amounted to 830±30N/mm$^2$. The test on magnetizability was carried out as described hereinabove and according to the aforementioned European Pat. No. 0,014,195. Prior to the test, the heavy-duty rod was subjected to magnetization at 120 kA/m. There could not be detected a single measuring point above 0.02 microteslas.

An analogous sample was subjected to a corresponding cold-working operation at room temperature and to magnetization at 10 kA/m. The complete rod exhibited a remaining magnetism of 10 microteslas.

TABLE I

| | MELT COMPOSITION DATA | | | | | | | | | | | | |
|---|---|---|---|---|---|---|---|---|---|---|---|---|---|
| | Elements in percent by weight | | | | | | | | | | | | |
| Melt No. | C | Si | Mn | P | S | Cr | Mo | Ni | $N_2$ | V | Nb/Ta | B | Al |
| 056391 | 0.065 | 0.60 | 19.33 | 0.025 | 0.010 | 13.50 | 0.43 | 2.0 | 0.21 | 0.15 | 0.28 | <0.0005 | 0.005 |
| 058156 | 0.061 | 0.50 | 19.11 | 0.045 | 0.006 | 13.40 | 0.44 | 1.77 | 0.22 | <0.03 | <0.1 | 0.002 | 0.004 |
| 059377 | 0.152 | 0.53 | 19.88 | 0.031 | 0.009 | 16.10 | 0.02 | 0.06 | 0.03 | | | | |
| 059378 | 0.120 | 0.50 | 20.76 | 0.029 | 0.010 | 13.80 | 0.79 | 0.04 | 0.04 | | | | |
| 059379 | 0.085 | 0.52 | 18.20 | 0.030 | 0.008 | 17.20 | 0.03 | 1.90 | 0.03 | | | | |
| 059380 | 0.097 | 0.50 | 19.46 | 0.028 | 0.012 | 14.80 | 0.02 | 0.05 | 0.18 | | | | |
| 059381 | 0.065 | 0.61 | 20.03 | 0.031 | 0.011 | 15.30 | 0.38 | 1.35 | 0.19 | | 0.15 | | |
| 010986 | 0.063 | 0.41 | 17.4 | 0.040 | 0.005 | 12.47 | 0.50 | 1.66 | 0.17 | | | | |
| 011226 | 0.073 | 0.38 | 18.07 | 0.029 | 0.007 | 12.54 | 0.45 | 1.60 | 0.19 | 0.18 | 0.20 | | 0.006 |
| 011829 | 0.058 | 0.48 | 13.26 | 0.032 | 0.008 | 16.20 | 0.61 | 4.83 | 0.25 | | | | 0.008 |
| 012035 | 0.076 | 0.53 | 23.53 | 0.038 | 0.005 | 11.90 | 0.86 | 0.95 | 0.16 | 0.12 | 0.21 | | 0.006 |
| 014698 | 0.047 | 0.45 | 24.01 | 0.042 | 0.011 | 17.20 | 0.91 | 3.34 | 0.31 | | | 0,001 | 0.03 |

The heretobefore given Table I illustrates the melt or alloy compositions which were investigated. Therein the melts numbered 056391 to 059381 were obtained in the laboratory whereas the melts numbered 010986 (as in the Example) to 014698 were obtained from actual production. The empty fields in Table I indicate that the related elements were not specifically determined but their concentration, in any case, was below the aforegiven lower limits. The following is particularly noted:

Laboratory melt No. 056391 contains molybdenum, nickel and nitrogen as well as niobium/tantalum in the preferred ranges and, additionally, vanadium; aluminum and boron are below their lower limits.

Laboratory melt No. 058156 is comparable to 056391 hereinabove with the exception of niobium/tantalum but, additionally, only contains boron whereas the concentrations of aluminum and vanadium like that of niobium/tantalum are below the respective lower limits.

In laboratory melt No. 059377 all of the concentrations of the elements molybdenum, nickel, nitrogen and niobium/tantalum as well as aluminum, boron and vanadium are below their preferred or lower limit ranges.

Laboratory melts Nos. 059378, 059379 and 059380 differ from the foregoing laboratory melt No. 059377 by respectively containing ether molybdenum, nickel or nitrogen in a concentration within the preferred range.

Laboratory melt No. 059381 differs from the foregoing laboratory melts No. 059377 to 059380 by containing all of molybdenum, nickel and nitrogen as well as niobium/tantalum in concentrations within the preferred range.

Production melt No. 010986 which corresponds to the Example, contains molybdenum, nickel and nitrogen within their preferred concentration range.

Comparable production melt No. 011226 additionally contains niobium/tantalum as well as vanadium within their preferred concentration ranges.

Production melts Nos. 011829 and 014698 differ between themselves with respect to the concentrations of manganese and chromium; with the exception of their high nickel concentrations, production melts No. 011829 and 014698 also are comparable to melt No. 010986 of the Example. Production melt No. 014698 additionally differs by containing aluminum and boron.

Production melt No. 012035 differs from production melt No. 010986 of the Example by containing more manganese and, additionally, vanadium and niobium/tantalum and thus is comparable, with the exception of manganese, with production melt No. 011226.

In the following Table II, there are listed the sample treatment and magnetization data. Forging or stretch forging, like in the Example, was carried out in the temperature range of 900° C. to 1150° C. and the samples were cold-worked at different temperatures. After cold-working, the samples were exposed to magnetic fields of different strengths and thereafter the magnetic flux density of the terrestrial magnetic field in the sample was measured in microtesla using the method as described in the aforementioned European Pat. No. 0,014,195.

The results obtained for the laboratory melts Nos. 056391 and 058156 are only limitedly comparable with the results obtained for the production melts No. 010986 to 014698. The reason is that the laboratory melts No. 056391 and 058156 were subjected, instead of the cold-working operation as described in the Example, to a practically uniform stretching operation which was devoid of the localized peak deformation stresses which occur during production when carrying out an actual cold-working process. Contrary thereto, the data of the production melts No. 010986 to 014698 were obtained from samples subjected to cold-working under the conditions as described in the Example.

The mechanical data, i.e. the 0.2 elastic limit after cold-working are practically independent of the cold-working temperature. Therefore, austenitic low-carbon manganese-chromium steel alloys which contain molybdenum, nickel and nitrogen and, optionally, niobium/tantalum can be cold-worked at temperatures or above the martensite formation temperature, i.e. at or above the temperature range of 300° C. to 350° C. without any significant loss in their desired mechanical properties.

The magnetization data indicate that practically all samples which have been cold-worked at 20° C., show unacceptable magnetism after exposure to comparatively low magnetic fields. Neglecting the differently cold-worked laboratory melts Nos. 056391 and 158156, no measurable or unacceptable magnetization was found on exposure to significantly higher magnetic fields when the samples were cold-worked as described in the Example and at temperatures in the range of 300° C. to 480° C., i.e. in the region of the upper limit of the martensite formation temperature or thereabove. In fact, the cold-working temperature can be increased up to the Curie point or the range of 700° C. to 750° C. No ferromagnetic inclusions, pockets or islands were observed in the material which has been cold-worked at such high temperatures, however, the 0.2 elastic limit is notably lower, see Table III, laboratory melt No. 059381.

The annexed Table III shows the 0.2 elastic limit data and the flux density data of the terrestrial magnetic field after exposure to a magnetic field of the field strength 50 kA/m, after the laboratory melts No. 059377 to 059381 were subjected to cold-working at different temperatures in the range of 20° C. to 750° C. and under the production conditions as described in the Example.

The composition data as given in Table I and discussed hereinbefore, show that the laboratory melts No. 059377 to 059380 contain none or only one of the required or essential alloying elements molybdenum, nickel and nitrogen which are required for carrying out the inventive method whereas the laboratory melt No. 059381 contains all of the aforementioned elements plus niobium/tantalum and the production melt No. 010986 contains all of the aforementioned elements with the exception of niobium/tantalum. The compositions of the presently discussed melts are otherwise comparable.

Regarding the mechanical data, it is apparent in Table III that the 0.2 elastic limits of laboratory melts Nos. 059377 to 059380 are inferior to those of labratory melt No. 059381 and production melt No. 010986 (see Table II) at all cold-working temperatures.

Regarding the magnetization data, Table III clearly shows that all of the laboratory melts Nos. 059377 to 059380 show unacceptable magnetism at all cold-working temperatures. Laboratory melt No. 059381 as well as production melt No. 010986 (see Table II) show no measurable or unacceptable magnetism at cold-working temperatures in the range of 300° C. to 750° C. and 400° C., respectively.

The data of Tables I to III thus demonstrate that the inventive method relies upon adding molybdenum, nickel and nitrogen as essential alloying components to austenitic lowl-carbon manganese-chromium steels and cold-working at the upper limit or above the martensite formation temperature. There are thus manufatured drilling string components, particularly heavy-duty drill-stems which have the desired mechanical strength and which are free of ferromagnetic inclusions, pockets or islands which would interfere with the terrestrial magnetic field measurements which are carried out during drilling operations. The further and optional addition of niobium and/or tantalum permits cold-working the the temperature range of about 300° C. to about 400° C.

TABLE II

SAMPLE TREATMENT AND MAGNETIZATION DATA

| Melt No. | Forging Temperature °C. | Cold-Working Temperature °C. | 0.2 Elastic Limit After Cold-Working N/mm² | Magnetization Field Strength k A/m | Flux Density Microtesla |
|---|---|---|---|---|---|
| 056391 | 900–1150 | 20 | 830 ± 60 | 20 | 1.0 |
| 056391 | 900–1150 | 250 | 760 ± 30 | 120 | 0.0 |
| 058156 | 900–1150 | 20 | 830 ± 60 | 50 | 0.1 |
| 058156 | 900–1150 | 100 | 830 ± 30 | 120 | 0.0 |
| 010986 | 900–1150 | 20 | 830 ± 60 | 10 | 10.0 |
| 010986 | 900–1150 | 400 | 830 ± 30 | 120 | 0.0 |
| 011226 | 900–1150 | 20 | 830 ± 60 | 20 | 3.0 |
| 011226 | 900–1150 | 300 | 830 ± 30 | 120 | 0.0 |
| 011829 | 900–1150 | 470 | 830 ± 30 | 120 | 0.0 |
| 012035 | 900–1150 | 360 | 830 ± 30 | 120 | 0.0 |
| 014698 | 900–1150 | 480 | 800 ± 30 | 120 | 0.0 |

TABLE III

MECHANICAL AND MAGNETIZATION DATA AS A FUNCTION OF COLD-WORKING TEMPERATURE

| Melt No. | Forging Temperature °C. | Cold-Working Temperature °C. | 0.2 Elastic Limit After Cold-Working N/mm² | Magnetization Field Strength k A/m | Flux Density Microtesla |
|---|---|---|---|---|---|
| 059377 | 900–1150 | 20 | 740 ± 60 | 50 | 12.0 |
| | 900–1150 | 150 | 740 ± 60 | 50 | 11.5 |
| | 900–1150 | 300 | 740 ± 60 | 50 | 9.0 |
| | 900–1150 | 350 | 720 ± 60 | 50 | 8.0 |
| | 900–1150 | 450 | 700 ± 60 | 50 | 3.0 |

TABLE III-continued

MECHANICAL AND MAGNETIZATION DATA AS A FUNCTION OF COLD-WORKING TEMPERATURE

| Melt No. | Forging Temperature °C. | Cold-Working Temperature °C. | 0.2 Elastic Limit After Cold-Working N/mm² | Magnetization Field Strength k A/m . | Flux Density Microtesla |
|---|---|---|---|---|---|
| 059378 | 900-1150 | 20 | 760 ± 60 | 50 | 14.0 |
| | 900-1150 | 150 | 760 ± 60 | 50 | 12.5 |
| | 900-1150 | 300 | 740 ± 60 | 50 | 10.0 |
| | 900-1150 | 350 | 730 ± 60 | 50 | 9.0 |
| | 900-1150 | 450 | 720 ± 60 | 50 | 5.0 |
| 059379 | 900-1150 | 20 | 750 ± 60 | 50 | 11.0 |
| | 900-1150 | 150 | 750 ± 60 | 50 | 10.0 |
| | 900-1150 | 300 | 720 ± 60 | 50 | 8.0 |
| | 900-1150 | 350 | 720 ± 60 | 50 | 6.0 |
| | 900-1150 | 450 | 700 ± 60 | 50 | 2.0 |
| 059380 | 900-1150 | 20 | 800 ± 60 | 50 | 9.0 |
| | 900-1150 | 150 | 800 ± 60 | 50 | 9.0 |
| | 900-1150 | 300 | 780 ± 60 | 50 | 6.0 |
| | 900-1150 | 350 | 760 ± 60 | 50 | 2.0 |
| | 900-1150 | 450 | 740 ± 60 | 50 | 0.5 |
| 059381 | 900-1150 | 20 | 830 ± 60 | 50 | 9.0 |
| | 900-1150 | 150 | 830 ± 60 | 50 | 2.0 |
| | 900-1150 | 300 | 820 ± 60 | 50 | <0.1 |
| | 900-1150 | 350 | 830 ± 60 | 50 | 0.0 |
| | 900-1150 | 450 | 810 ± 60 | 50 | 0.0 |
| | 900-1150 | 750 | 480 ± 60 | 50 | 0.0 |

While there are shown and described present preferred embodiments of the invention, it is to be distinctly understood that the invention is not limited thereto, but may be otherwise variously embodied and practiced within the scope of the following claims. Accordingly,

What we claim is:

1. A method manufacturing nonmagnetic heavy duty drilling string components for exploratory and directional bores for crude oil and natural gas deposits, comprising the steps of:

melting and allowing to solidify an alloy consisting essentially of, each in percent by weight:

carbon in a maximum of about 0.15;

silicon in a maximum of about 1.0;

manganese about 11.0 to about 25.0;

chromium about 10.0 to about 20.0;

molybdenum about 0.1 to about 1.0;

nickel about 0.1 to about 6.0;

nitrogen about 0.05 to about 0.5;

the remainder being iron and other impurities resulting from manufacturing conditions;

subjecting the alloy to a hot-working operation;

solution heat-treating the alloy at temperatures of about 1,020° C. to about 1,070° C.;

subsequently quenching the alloy;

subjecting the quenched alloy to a cold-working operation at a temperature in the range of above 350° C. to below about 750° C.; and said step of cold-working said alloy entails cold-working to at least 5% deformation.

2. The method as defined in claim 1, further including the step of:

selecting as said alloy, an alloy consisting essentially of, each in percent by weight:

carbon in a maximum of 0.08;

manganese about 12.0 to about 20.0;

chromium about 11.0 to about 16.0;

molybdenum about 0.2 to about 0.8;

nickel about 1.0 to about 2.5;

nitrogen about 0.1 to about 0.35, and the remainder being iron and other impurities resulting from manufacturing coniditions.

3. The method as defined in claim 1, wherein:

said step of hot-working said alloy entails a hot-working operation resulting in a 2:1 area reduction.

4. The method as defined in claim 1, wherein:

said step of hot-working said alloy entails a hot-working operation resulting in a 4–6:1 area reduction.

5. The method as defined in claim 1, further including the step of:

cooling said alloy after said hot-working operation and prior to said solution heat treatment.

6. The method as defined in claim 1, wherein:

said step of quenching said alloy entails quenching the alloy in water.

7. The method as defined in claim 1, wherein:

said step of cold-working is performed at a maxium temperature below the Curie point of iron.

8. The method as defined in claim 1, wherein:

said step of cold-working said alloy entails cold-working at a temperature below 550° C.

9. The method as defined in claim 1, wherein:

said step of cold-working is performed at a temperature which is above the upper limit of the martensite formation temperature.

10. The method as defined in claim 1, wherein:

said step of cold-working said alloy entails cold forging.

11. The method as defined in claim 10, wherein:

said cold forging entails stretch forging.

12. The method as defined in claim 1, wherein:

said step of cold-working said alloy entails cold-working to at least 12% deformation.

13. The process as defined in claim 1, further including the step of:

mechanically processing said alloy following the cold-working operation.

14. The method as defined in claim 13, wherein:

said step of mechanically processing said alloy entails machining said alloy.

15. The method as defined in claim 1, further including the steps of:

locally cold-working said alloy in marginal regions close to the surface of said alloy at a temperature in the range of above 350° C. to below about 750° C. in order to thereby produce inherent compressive stresses.

16. The method as defined in claim 15, wherein:
said step of locally cold-working said alloy entails ball-blasting.

17. The method as defined in claim 16, wherein:
said step of locally cold-working said alloy entails cold-working below the Curie point of iron.

18. The method as defined in claim 15, wherein:
said step of locally cold-working said alloy entails cold-working at a temperature below 550° C.

19. The method as defined in claim 15, wherein:
said step of locally cold-working said alloy entails cold-working at a temperature which is above the upper limit of the martensite formation temperature.

20. A method of manufacturing nonmagnetic heavy duty drilling string components for exploratory and directional bores for crude oil and natural gas deposits, comprising the steps of:

melting and allowing to solidify an alloy consisting essentially of, each in percent by weight:
carbon in a maximum of about 0.15;
silicon in a maximum of about 1.0;
manganese about 11.0 to about 25.0;
chromium about 10.0 to about 20.0;
molybdenum about 0.1 to about 1.0;
nickel about 0.1 to about 6.0;
niobium/tantalum above 0.1 to about 2.0
nitrogen about 0.5 to about 0.5;
the remainder being iron and other impurites resulting from manufacturing conditions;
subjecting the alloy to a hot-working operation;
solution heat-treating the alloy at temperatures of about 1,020° C. to about 1,070° C.;
subsequently quenching the alloy;
subjecting the quenched alloy to a cold-working operation at a temperature in the range of about 300° C. to below about 750° C.; and
said step of cold-working said alloy entails cold-working to at least 5% deformation.

21. The method as defined in claim 20, further including the step of:
selecting as said alloy, an alloy consisting essentially of, each in percent by weight:
carbon in a maximum of 0.8;
manganese about 12.0 to about 20.0;
chromium about 11.0 to about 16.0;
molybdenum about 0.2 to about 0.8;
nickel about 1.0 to about 2.5;
nitrogen about 0.1 to about 0.35,
and the remainder being iron and other impurities resulting from manufacturing conditions.

22. The method as defined in claim 20, wherein: said step of cold-working entails cold-working at a temperature in the range of about 300° C. to 400° C.

23. The method as defined in claim 20, wherein:
said alloy containing niobium/tantalum in an amount of about 0.4 to 0.8 percent by weight.

24. The method as defined in claim 20, wherein:
said step of hot-working said alloy entails a hot-working operation resulting in a 2:1 area reduction.

25. The method as defined in claim 20, wherein:
said step of hot-working said alloy entails a hot-working operation resulting in a 4–6:1 area reduction.

26. The method as defined in claim 20, further including the step of:
cooling said alloy after said hot-working operation and prior to said solution heat treatment.

27. The method as defined in claim 20, wherein:
said step of quenching said alloy entails quenching the alloy in water.

28. The method as defined in claim 20, wherein:
said step of cold-working is performed at a maximum temperature below the Curie point of iron.

29. The method as defined in claim 20, wherein:
said step of cold-working said alloy entails cold forging.

30. The method as defined in claim 29, wherein:
said cold forging entails stretch forging.

31. The method as defined in claim 20, wherein:
said step of cold-working said alloy entails cold-working to at least 12% deformation.

32. The process as defined in claim 20, further including the step of:
mechanically processing said alloy following the cold-working operation.

33. The method as defined in claim 32, wherein:
said step of mechanically processing said alloy entails machining said alloy.

34. The method as defined in claim 20, further including the steps of:
locally cold-working said alloy in marginal regions close to the surface of said alloy at a temperature in the range of about 300° C. to below about 750° C. in order to thereby produce inherent compressive stresses.

35. The method as defined in claim 34, wherein:
said step of locally cold-working said alloy entails ball-blasting.

36. The method as defined in claim 35, wherein:
said step of locally cold-working said alloy entails cold-working below the Curie point of iron.

37. The method as defined in claim 34, wherein:
said step of locally cold-working said alloy entails cold-working at a temperature below 550° C.

38. The method as defined in claim 34, wherein:
said step of locally cold-working said alloy entails cold-working at a temperature which is at least equal to the upper limit of the martensite formation temperature.

* * * * *